US011320190B2

(12) United States Patent
Larson

(10) Patent No.: US 11,320,190 B2
(45) Date of Patent: May 3, 2022

(54) REFRIGERATOR DIVERTER VALVE USING FLUIDIC CIRCUIT

(71) Applicant: Illinois Tool Works Inc., Glenview, IL (US)

(72) Inventor: Eric K. Larson, Cumberland, RI (US)

(73) Assignee: Illinois Tool Works Inc., Glenview, IL (US)

( * ) Notice: Subject to any disclaimer, the term of this patent is extended or adjusted under 35 U.S.C. 154(b) by 682 days.

(21) Appl. No.: 16/087,951

(22) PCT Filed: Apr. 27, 2017

(86) PCT No.: PCT/US2017/002982
§ 371 (c)(1),
(2) Date: Sep. 24, 2018

(65) Prior Publication Data

US 2021/0199365 A1 Jul. 1, 2021

Related U.S. Application Data

(60) Provisional application No. 62/332,710, filed on May 6, 2016.

(51) Int. Cl.
*F25D 17/06* (2006.01)
*F25D 17/04* (2006.01)

(52) U.S. Cl.
CPC ..... *F25D 17/065* (2013.01); *F25D 17/045* (2013.01); *F25D 2317/0653* (2013.01); *F25D 2317/0683* (2013.01); *F25D 2400/04* (2013.01)

(58) Field of Classification Search
CPC ..... F25D 17/065; F25D 17/045; F25D 2317/0653; F25D 2317/0683; F25D 2400/04
See application file for complete search history.

(56) References Cited

U.S. PATENT DOCUMENTS

| | | | | |
|---|---|---|---|---|
| 3,290,893 | A | 12/1966 | Haldopoulos | |
| 3,826,103 | A * | 7/1974 | Grover | F25D 21/02 62/140 |
| 5,711,159 | A * | 1/1998 | Whipple, III | F25D 17/065 62/186 |
| 5,881,568 | A * | 3/1999 | Kim | F25D 17/065 62/443 |
| 2005/0061016 | A1* | 3/2005 | Lee | F25C 5/046 62/340 |
| 2005/0204773 | A1* | 9/2005 | Imai | F25D 11/02 62/512 |

(Continued)

FOREIGN PATENT DOCUMENTS

| | | | |
|---|---|---|---|
| CN | 105402464 | A | 3/2016 |
| FR | 2389789 | A1 | 12/1978 |

(Continued)

*Primary Examiner* — David J Teitelbaum
(74) *Attorney, Agent, or Firm* — Boyle Fredrick, S.C.

(57) ABSTRACT

A refrigerator damper system employs a fluidic valve providing switching of air between refrigerated compartments without the need for a movable valve plate such as can be obstructed by ice. In one embodiment, a bidirectional fan provides switching from a first compartment to a second compartment and then from a second compartment to a first compartment with change of fan direction.

20 Claims, 3 Drawing Sheets

(56) References Cited

U.S. PATENT DOCUMENTS

| | | | | |
|---|---|---|---|---|
| 2006/0266075 | A1* | 11/2006 | Itsuki | F25B 40/00 62/512 |
| 2008/0134712 | A1* | 6/2008 | Civanelli | F25D 17/042 62/382 |
| 2015/0040605 | A1* | 2/2015 | Gorz | F25D 17/065 62/407 |

FOREIGN PATENT DOCUMENTS

| | | | |
|---|---|---|---|
| GB | 1219732 | A | 1/1971 |
| GB | 1381405 | A | 1/1975 |

* cited by examiner

REFRIGERATOR DIVERTER VALVE USING FLUIDIC CIRCUIT

CROSS REFERENCE TO RELATED APPLICATIONS

This application claims the benefit of U.S. provisional application 62/332,710 filed May 6, 2016, and hereby incorporated by reference.

FIELD OF THE INVENTION

The present invention relates to refrigerators and the like and specifically to a diverter valve for controlling the flow of refrigerated air into different refrigerator compartments.

BACKGROUND OF THE INVENTION

Refrigerators for the storage of food or the like may provide for separate compartments, each maintained at different temperatures. One compartment may be maintained at a temperature substantially below freezing for the storage of frozen food. The other compartment may be maintained at a temperature above freezing for the storage of fresh foods. These different temperatures can be maintained by selectively controlling the flow of air cooled by the refrigerator evaporator (a heat absorber) into one or the other compartment.

Such airflow control is typically provided by an air damper implemented as a mechanical diverter valve of a type having a movable valve plate, such as a flapper door, that is operable by an electric actuator in turn controlled by a refrigerator control circuit. The flapper door is moved between two positions to direct air from the evaporator into one compartment or the other depending on the actuator operation.

The movable flapper door is subject to blockage by the accumulation of ice on the movable valve plate and its engaging valve seats. In addition, the actuator or linkage between the actuator and movable valve plate can become encrusted with ice also interfering with reliable operation of the diverter valve.

SUMMARY OF THE INVENTION

The present invention provides a diverter valve using a fluidic circuit to stably switch airflow from a refrigerator evaporator to one of two compartments without the need for a movable flapper door. The fluidic circuit provides two outlet channels and directs airflow between the channels by a short air jet from an associated electric fan which causes the airflow to "attach" to a different outflow channel. The fluidic circuit eliminates the need for a movable valve plate and its associated sealing tolerances and thus problems of blockage in the movement of the valve plate caused by accumulated ice.

In one embodiment, the invention provides a refrigerator damper system for use in a refrigerator of a type providing first and second compartments receiving refrigerated airflow from a refrigeration circuit including a heat absorbing portion such as an evaporator. The refrigerator damper system includes a diverter housing providing an inlet communicating to a first and second outlet, the latter adapted to communicate with the first and second compartments respectively. A first electrically controllable fan transports air cooled by the heat absorbing portion to the inlet of the diverter housing. The diverter housing provides a fluidic valve having a first main channel leading from the inlet and separating at a bifurcation to first and second channels communicating, respectively, with each of first and second outlets and further having at least one control port positioned at the bifurcation, the control port adapted to conduct air therethrough to steer air from the main channel between the first and second channels. A second electrically controllable fan may transport air through the control port.

It is thus a feature of at least one embodiment of the invention to eliminate the need for movable damper elements that must seal against air leakage and thus that are susceptible to freezing in place with the accumulation of frost or ice.

The bifurcation is adapted to produce an attachment of airflow to a single given wall of either of the first and second channels when air is flowing through the given first and second channels to provide a bi-stable switching of air between the first and second channels without operation of the second electrically controllable fan to move air through the control port.

It is thus a feature of at least one embodiment of the invention to provide a damper system that does not require electrical power to be expended by the second fan except during the switching of airflow, thus conserving energy.

The second electrically controllable fan maybe bidirectional and operates in a first direction to move air from the first to the second channel and in a second direction to move air from the second to the first channel.

It is thus a feature of at least one embodiment of the invention to eliminate the need for two separate control fans to provide control jets for the fluidic valve.

The refrigerator damper system may further include an air reducer communicating between the first electrically controllable fan and the bifurcation to provide an increasing air velocity.

It is thus a feature of at least one embodiment of the invention to provide sufficient air velocity to promote the Coandă effect providing for bi-stability while allowing for slower airflow over the refrigerator heat exchanger for maximum thermal interchange.

The diverter housing may be a thermally insulating material having a thermal conductivity of less than 0.1 W/(m/k) such as a polymer material. In one embodiment the material may be an expanded polystyrene foam.

It is thus a feature of at least one embodiment of the invention to provide a diverter that may be constructed of insulating materials forming part of the insulating walls of the compartments.

The main channel and the first and second channels may be coplanar and have an extent perpendicular to the plane of less than two inches. The first and second outlets may open to allow airflow perpendicular to the plane.

It is thus a feature of at least one embodiment of the invention to provide a diverter valve that can fit between the first and second compartment within the space normally allocated to insulation.

The refrigerator damper system may further include an airflow sensor in at least one of the first and second channels.

It is thus a feature of at least one embodiment of the invention to permit active sensing of airflow to ensure upper switching and continuity of switching (for example, when the door the refrigerator is opened) and to minimize operation of the second fan.

The second electrically controllable fan may provide a lower airflow than the first electrically controllable fan and/or may provide lower power consumption than the first electrically controllable fan.

It is thus a feature of at least one embodiment of the invention to provide a control of airflow that reduces the need for expensive or high-power actuators.

Other features and advantages of the invention will become apparent to those skilled in the art upon review of the following detailed description, claims and drawings in which like numerals are used to designate like features.

Figure 1:
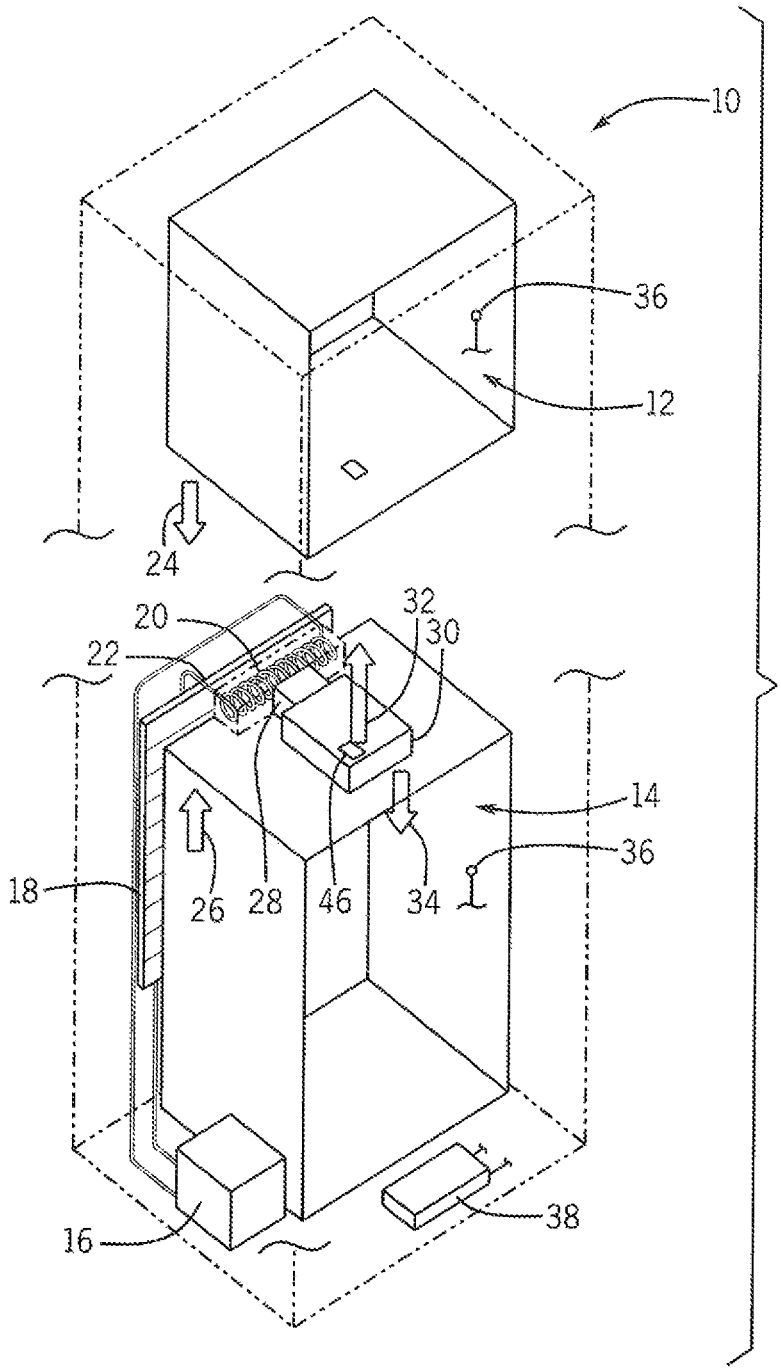
FIG. 1 is a simplified phantom view of a refrigerator incorporating the (livelier valve of the present invention for directing air from an evaporator into a freezer or fresh food compartment.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, a refrigerator 10 may have a freezer chamber 12 and a separate fresh food chamber 14. Each, chamber 12 and 14 defines an enclosed space sealable with a door (not shown) with the freezer chamber 12 intended for the storage of frozen foods and the like at temperatures below freezing and the fresh food chamber 14 intended for the storage of fresh foods and the like at temperatures below ambient temperature but above freezing.

The refrigerator may provide for a compressor 16 moving a refrigeration liquid successively through a condenser coil 18 expelling heat from the refrigerated liquid into outside air and then through an evaporator coil 20 absorbing heat into the refrigerated liquid (typically after a Joule Thomson expander) from the air in the refrigerator 10 around the evaporator coil 20.

The evaporator coil 20 may be held within a plenum 22 that may receive either or both of freezer chamber air 24 from the freezer chamber 12 or fresh food chamber air 26 from the fresh food chamber 14 to cool the same. A fan 28 draws air from the plenum 22 after cooling by the evaporator coil 20 into a fluidic diverter valve 30. The fluidic diverter valve 30 may direct the cooled air in one direction as freezer chamber replenishment air 32 into the freezer chamber 12 or in another direction as fresh food chamber replenishment air 34 into the fresh food chamber 14 according to principles that will be described below.

Each of the freezer chamber 12 and fresh food chamber 14 may include a temperature sensor 36 for sensing the temperature of that respective chamber. These temperature sensors 36 may communicate with a refrigerator controller module 38, for example, being a microcontroller executing a stored program held in computer memory for the control of the refrigerator 10. The refrigerator controller module 38 may also communicate with sensors and actuators within the diverter valve 30 as will be discussed.

Figure 2:
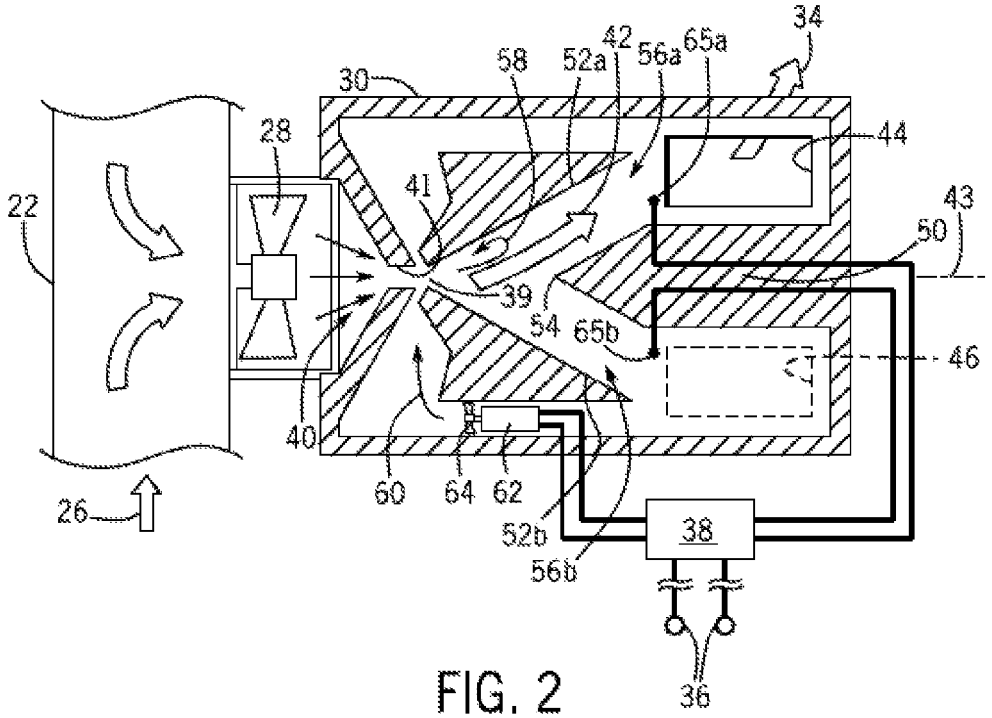
FIG. 2 is a cross-section along the horizontal plane through the diverter valve of FIG. 1 showing airflow through the diverter valve in a first state.

Referring now to FIG. 2, air drawn from the plenum 22 by the fan 28 is received into a housing of the diverter valve 30 via a funnel-shaped reducer 40. The reducer 40 increases the air velocity of air flowing from the plenum 22 as it is received by the diverter valve 30 producing a refrigerated air jet 42 exiting within the housing of the diverter valve 30 along an axis 43 from a nozzle 41. The refrigerated air jet 42 passes to a bifurcation entrance 39 where it may be directed alternatively along one of two channels 56*a* and 56*b*, the first directed toward an opening 44 in the housing of the diverter valve 30 providing fresh food chamber replenishment air 34 to the fresh food chamber 14 (as shown) and the second directed to an opening 46 providing freezer chamber replenishment air 32 (not shown in FIG. 2) to the freezer chamber 12. Openings 44 and 46 are displaced by the channels 56 away from the nozzle 41 along the axis 43 on opposite sides of the housing of the diverter valve 30.

The channels 56*a* and 56*b* are separated by a flow splitter wall 50 (defining inner walls of channels 56*a* and 56*b*) which extends along the axis 43 from a wall opposite the nozzle 41 separating the openings 44 and 46 toward the nozzle 41 such as allows the refrigerated air jet 42 to pass on either side of the flow splitter wall 50 to exit from either of the openings 46 or 44. The tip 54 of the flow splitter wall 50 is pointed and faces toward the nozzle 41.

As is understood in the art, the refrigerated air jet 42 will tend to attach to one outer wall 52*a* or 52*b* of the channels 56*a* or 56*b* to the exclusion of the other flanking wall 52*a* or 52*b*. This attachment operates through the agency of a low-pressure bubble 58 between the refrigerated air jet 42 and the given wall 52 of a channel 56 being a manifestation of the Coandă effect. This attachment is shown directing the refrigerated air jet 42 toward opening 44 in FIG. 2.

The nozzle 41 and the bifurcation entrance 39 are spaced apart along axis 43 to provide for lateral gaps such as will permit passage of a control air jet 60 directed generally perpendicular to the airflow from the nozzle 41. This control air jet 60 may push or pull the refrigerated air jet 42 laterally perpendicular to axis 43 to move it between channels 56*a* and 56*b*. Once attached to a given wall 52*a* or 52*b*, the control air jet 60 may stop and the refrigerated air jet 42 will be held by the Coandă effect to that wall 52 when the first jet of air ceases.

Alternatively, it will be understood that two separate control air jets 60 may be used, passing through one or the other of gaps on either side of the nozzle 41, with one control air jet 60 operating to push the refrigerated air jet 42 to wall 52*a* and one control air jet 60 operating to push the refrigerated air jet 42 to wall 52*b*.

As shown in FIG. 2, in one embodiment, the present invention provides a DC motor 62 and fan 64 within the housing of the diverter valve 30 that may be actuated by the refrigerator control module 38 to rotate in a first direction to generate the control air jet 60 exiting between the nozzle 41 and wall 52*b* to push the refrigerated air jet 42 against wall 52*a* to exit through opening 44. Operation of the DC motor 62 may then cease and the Coandă effect may hold the refrigerated air jet 42 in the channel 56*a* without further power consumption by the DC motor 62. This DC motor 62 and fan 64 may be positioned in a location removed from channels 56*a* and 56*b* but generally communicating with the air within the diverter valve 30.

Figure 3:
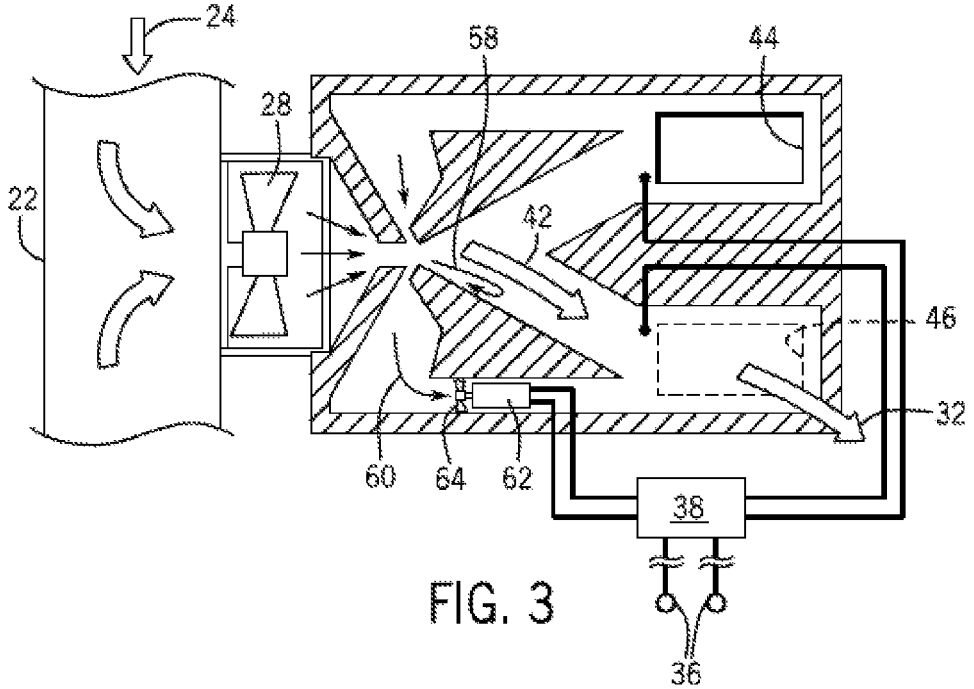
FIG. 3 is a figure similar to FIG. 2 showing airflow through the diverter valve in a second state.

Referring now to FIG. 3, when the DC motor 62 is operated in the reverse direction, the control air jet 60 may provide a suction at the gap between the nozzle 41 and wall 52*b* drawing the refrigerated air jet 42 against the wall 52*b* to exit out of opening 46. After this attachment of the refrigerated air jet 42 to the wall 52*b*, operation of the DC motor 62 may cease with the Coandă effect holding the refrigerated air jet 42 in the channel 56*b* without further power consumption by the DC motor 62. It will be appreciated that there is no flapper door or attached actuator in this arrangement that may accumulate ice blocking its operation. Because the fan 64 operates with cooled air within the diverter valve 30 provided from the plenum 22, the normal problems of condensation from introduced external air are not present. In addition the fan 64 may operate with substantial clearance around the fan with respect to the walls of the diverter valve 30 limiting the possibility of ice blockage of the fan mechanism.

Referring still to FIGS. 2 and 3, each of the channels 56*a* and 56*b* may include an airflow sensor 65*a* or 64*b*, respectively, providing signals to the refrigerator controller module 38 to ensure proper switching of the refrigerated air jet 42 between the freezer chamber 12 and the fresh food chamber 14 such as may be used to control the duration of operation of the motor 62 only to the point where the refrigerated air jet 42 has properly changed position or provided a resetting operation of the motor 62 if the refrigerated air jet 42 should inadvertently change position. The airflow sensors 65 may, for example, be self-heated NTC thermistors providing mass flow sensing.

Figure 4:
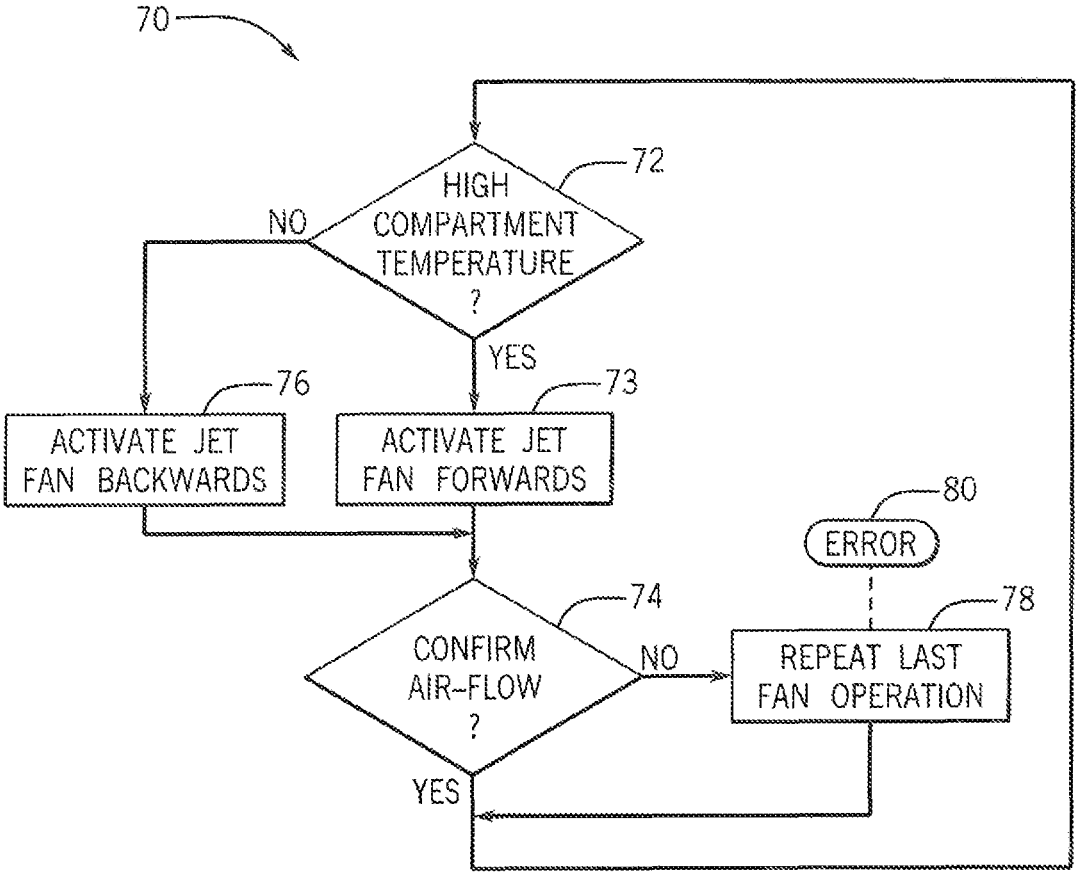
FIG. 4 is a flowchart of a program executed by a controller of the refrigerator of FIG. 1 for operating the diverter valve of FIGS. 2 and 3.

Referring now to FIGS. 1, 2, and 4, a control program 70 executed by the refrigerator controller module 38 (shown in FIG. 1) may monitor the temperature of fresh food chamber 14 using the temperature sensor 36 as indicated by decision block 72 to determine whether the temperature in the fresh food chamber 14 is above a desired setpoint temperature (typically set by the consumer using a thermostat knob). If so, the diverter valve 30 is switched as indicated by process block 73 by operating the fan 64 in a forward direction to push, the refrigerated air jet 42 (shown in FIG. 2) toward wall 52*a* to exit into the fresh food, chamber 14. This activation of the fan 64 may be coordinated with operation of the fan 28 and be momentary according to a predetermined time interval or until airflow is detected by airflow sensor 65*a* per decision block 74 confirming proper operation. Activation of the fan 64 is not performed if the previous activation of the fan 64 was in the forward direction per a previous execution of process block 73 and airflow was sensed by sensor 65*a* at decision block 74. The fan 28 may be controlled h a separate control loop managing the temperature of the freezer chamber 12 using temperature sensor 36.

To the contrary, if at decision block 72 the temperature of the fresh food chamber 14 is below the predetermined setpoint, then at process block 76 the fan 64 is momentarily operated in the reverse direction to pull the refrigerated air jet 42 toward the wall 52*b* to exit into the freezer chamber 12. Again this activation may be coordinated with operation of the fan 28 and for a period of time based on a predetermined time interval necessary to perform a switching of air stream using the diverter valve 30*s* or until proper completion of the switching operation indicated by sensor 65*b* per the confirmation decision block 74. This operation of the fan occurs only if the previous activation of the fan 64 was not in the backward direction.

If at confirmation decision block 74 proper airflow is not confirmed after process blocks 73 or 76, the program may proceed to process block 78 and the previous fan operation of decision blocks 73 and 76 may be repeated. If after a predetermined number of repetitions proper airflow is not obtained, an error condition may be generated per process block 80.

It will be appreciated that the diverter valve 30 may be fashioned of an insulating material such as Styrofoam normally separating the freezer chamber 12 from the fresh food chamber 14 thus providing an extremely low-cost element.

In one embodiment, the openings 44 and 46 may be 2-inch by 1.2-inch rectangles and the height of the diverter valve 30 measured perpendicular to the plane of FIGS. 2 and 3 may be 1.2 inches to fit within the normal space between the freezer chamber 12 and the fresh food chamber 14. The total area of the diverter valve 30 in the plane depicted in FIGS. 2 and 3 may be 4 inches by 6 inches.

The term "fan" used herein shall be understood to be motorized devices for moving air including squirrel cage blowers, fans, propellers and the like. Generally, the housing of the refrigerator 10 including the walls between the freezer chamber 12 and the fresh food chamber 14 may be constructed of a material having a high thermal resistance and accordingly a low thermal conductivity of less than 0.2, for example, as is provided by most polymer materials and ideally less than 0.1 for, example, as exhibited by expanded polystyrene having a thermal conductivity of approximately 0.03.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. A refrigerator damper system for use in a refrigerator providing first and second compartments receiving refrigerated airflow and a refrigeration circuit including a heat absorbing portion, the refrigerator damper system comprising:

a diverter housing providing an inlet communicating to a first and second outlet, the latter adapted to communicate with the first and second compartments respectively;

a first electrically controllable fan for transporting air cooled by the heat absorbing portion to the inlet of the diverter housing as a refrigerated airflow;

wherein the diverter housing provides a fluidic valve having a first main channel leading from the inlet and separating at a bifurcation to a first and second channel communicating respectively with each of first and second outlets and further having at least one control port positioned upstream of the bifurcation, the control port adapted to conduct a control air jet therethrough and angularly with respect to the refrigerated airflow to steer the refrigerated airflow from the main channel between the first and second channels; and a second electrically controllable fan for transporting air through the control port;

wherein:

when the second electrically controllable fan is in a first operational state, the second electrically controllable fan forces the control air jet to flow along a first path and the refrigerated airflow is steered by the control air jet in the control port toward the first channel; and when the second electrically controllable fan is in a second operational state, the second electrically controllable fan forces the control air jet to flow along a second path and the refrigerated airflow is steered by the control air jet in the control port toward the second channel.

2. The refrigerator damper system of claim 1 wherein the bifurcation is adapted to produce an attachment of airflow to a single given wall of either of the first and second channels when air is flowing through the given first and second channel to provide a bi-stable switching of air between the first and second channels without operation of the second electrically controllable fan to move air through the control port.

3. A refrigerator damper system for use in a refrigerator providing first and second compartments receiving refrigerated airflow and a refrigeration circuit including a heat absorbing portion, the refrigerator damper system comprising:

a diverter housing providing an inlet communicating to a first and second outlet, the latter adapted to communicate with the first and second compartments respectively;

a first electrically controllable fan for transporting air cooled by the heat absorbing portion to the inlet of the diverter housing;

wherein the diverter housing provides a fluidic valve having a first main channel leading from the inlet and separating at a bifurcation to a first and second channel communicating respectively with each of first and second outlets and further having at least one control port positioned at the bifurcation, the control port adapted to conduct air therethrough to steer air from the main channel between the first and second channels;

a second electrically controllable fan for transporting air through the control port; and wherein the second electrically controllable fan is bidirectional and operates in a first direction to move air from the first to the second channel and in a second direction to move air from the second to the first channel.

4. The refrigerator damper system of claim 1 further including an air reducer communicating between the first electrically controllable fan and the bifurcation to provide an increasing air velocity.

5. The refrigerator damper system of claim 1 wherein the diverter housing is a thermally insulating material having a thermal conductivity of less than 0.1 W/(m/k).

6. The refrigerator damper system of claim 5 wherein the diverter housing is a polymer material.

7. The refrigerator damper system of claim 6 wherein the diverter housing is an expanded polystyrene foam.

8. The refrigerator damper system of claim 1 wherein the main channel and the first and second channels are coplanar and have an extent perpendicular to the plane of less than two inches.

9. The refrigerator damper system of claim 8 wherein the first and second outlets open to allow airflow perpendicular to the plane.

10. The refrigerator damper system of claim 1 further including an airflow sensor in at least one of the first and second channels.

11. The refrigerator damper system of claim 1 further including a controller operating to switch airflow between the first and second channels by operation of the second electrically controllable fan during continuous operation of the first electrically controllable fan.

12. The refrigerator damper system of claim 11 wherein the controller provides a momentary operation of the second electrically controllable fan in a first direction for moving the airflow from the first to the second channel and in a second direction for moving the airflow from the second to the first channel.

13. The refrigerator damper system of claim 12 wherein the controller further receives flow sensing from at least one of the first and second channels to provide an error signal if, after momentary operation of the second electrically controllable fan to move airflow to a given one of the first and second channel, the airflow sensor does not indicate airflow in the given one of the first and second channel.

14. The refrigerator damper system of claim 1 wherein the second electrically controllable fan provides lower airflow than the first electrically controllable fan.

15. The refrigerator damper system of claim 14 wherein the second electrically controllable fan provides lower power consumption than the first electrically controllable fan.

16. A refrigerator comprising:

a refrigeration circuit pumping heat between a heat absorbing portion and a heat expelling portion;

a first and second insulated compartment for maintaining different air temperatures;

a temperature sensor in at least one of the first and second insulated compartments;

a diverter providing:

(a) a diverter housing providing an inlet communicating to a first and second outlet, the latter adapted to communicate with the first and second compartments respectively;

(b) a first electrically controllable fan for transporting air cooled by the heat absorbing portion to the inlet of the diverter housing;

wherein the diverter housing provides a fluidic valve having a first main channel leading from the inlet and separating at a bifurcation to a first and second channel communicating respectively with each of first and second outlets and further having at least one control port positioned at the bifurcation, the control port adapted to conduct air therethrough to steer air from the main channel between the first and second channels; and (c) a second electrically controllable fan for transporting air through the control port; and a controller receiving a signal from the temperature sensor controlling the refrigeration circuit and operating the first electrically controllable fan when the refrigeration circuit is active and controlling the second electrically controllable fan to switch airflow between the first and second compartments according to the signal from the temperature sensor.

17. The refrigerator of claim 16 wherein the first and second insulated compartments are separated by an insulated wall holding the diverter housing.

18. The refrigerator damper system of claim 16 wherein the diverter housing is a thermally insulating material having a thermal conductivity of less than 0.1 W/(m/k).

19. The refrigerator damper system of claim 16 wherein the bifurcation is adapted to produce an attachment of airflow to a single given wall of the first and second channels when air is flowing through the given first and second channel to provide a bi-stable switching of air between the first and second channels without operation of the second electrically controllable fan to move air through the control port and wherein the controller operates the second electrically controllable fan during operation of the first electrically controllable fan to move the airflow between the first and second channels.

20. The refrigerator damper system of claim 16 wherein the controller provides operation of the second electrically controllable fan in a first direction for moving the airflow from the first to the second channel and in a second direction for moving the airflow from the second to the first channel.

* * * * *